US010855002B2

(12) United States Patent
Lötkemann et al.

(10) Patent No.: US 10,855,002 B2
(45) Date of Patent: Dec. 1, 2020

(54) ACTUATOR FOR A CONNECTION DEVICE FOR ELECTRICAL CONDUCTORS

(71) Applicant: HARTING Electric GmbH & Co. KG, Espelkamp (DE)

(72) Inventors: Irina Lötkemann, Rahden (DE); Andreas Rüter, Rahden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/317,780

(22) PCT Filed: Jul. 24, 2017

(86) PCT No.: PCT/DE2017/100613
§ 371 (c)(1),
(2) Date: Jan. 14, 2019

(87) PCT Pub. No.: WO2018/019329
PCT Pub. Date: Feb. 1, 2018

(65) Prior Publication Data

US 2019/0221951 A1 Jul. 18, 2019

(30) Foreign Application Priority Data

Jul. 28, 2016 (DE) ..... 10 2016 113 974

(51) Int. Cl.
*H01R 4/48* (2006.01)

(52) U.S. Cl.
CPC ..... *H01R 4/4827* (2013.01); *H01R 4/4836* (2013.01); *H01R 4/4845* (2013.01)

(58) Field of Classification Search
CPC ... H01R 4/4845; H01R 4/4827; H01R 4/4836
See application file for complete search history.

(56) References Cited

U.S. PATENT DOCUMENTS 5,494,456 A * 2/1996 Kozel ..... H01R 4/4827 439/439
6,500,021 B2 * 12/2002 Wilmes ..... H01R 4/2433 439/395

(Continued)

FOREIGN PATENT DOCUMENTS

DE 42 39 480 A1 5/1994
DE 10 2007 009 082 A1 9/2007

(Continued)

OTHER PUBLICATIONS

German Office Action, dated Jul. 27, 2017, for German Application No. 10 2016 113 974.2, 8 pages.

(Continued)

*Primary Examiner* — Briggitte R. Hammond
(74) *Attorney, Agent, or Firm* — Seed IP Law Group LLP; Jared M. Barrett

(57) ABSTRACT

A problem addressed by embodiments of the invention disclosed herein consists in devising a connection device in which field terminations can be released also in the installed state, i.e., the electrical conductors can be manually disconnected using a simple tool even if the insulating body is already installed in an attachment housing. To this end, an actuator is proposed which has an inclined engagement portion with an adjoining engagement edge and engagement step by which the actuator can be lifted out of the insulating body, also from the cable connection side, with a slotted screwdriver in a single lifting movement.

8 Claims, 5 Drawing Sheets

(56) References Cited

U.S. PATENT DOCUMENTS

| | | | | |
|---|---|---|---|---|
| 6,527,580 | B1 * | 3/2003 | Suss | H01R 9/2625 439/417 |
| 6,682,364 | B2 * | 1/2004 | Cisey | H01R 9/2666 439/441 |
| 6,796,855 | B2 * | 9/2004 | Fricke | H01R 4/4818 439/835 |
| 7,004,781 | B2 * | 2/2006 | Walter | H01R 4/4836 439/268 |
| 7,104,833 | B2 * | 9/2006 | Oesterhaus | H01R 4/4836 439/441 |
| 7,438,587 | B2 * | 10/2008 | Germani | H01R 4/4836 439/441 |
| 7,762,834 | B2 * | 7/2010 | Schrader | H01R 4/4836 439/441 |
| 8,251,738 | B2 * | 8/2012 | Heckert | H01R 4/4836 439/441 |
| 9,331,427 | B2 * | 5/2016 | Tedeschi | H01R 4/4836 |
| 9,553,387 | B2 * | 1/2017 | Tedeschi | H01R 13/42 |
| 2007/0010135 | A1 | 1/2007 | Ferderer | |
| 2007/0207662 | A1 | 9/2007 | Germani | |
| 2014/0141657 | A1 | 5/2014 | Germani | |
| 2014/0227914 | A1 | 8/2014 | Tedeschi | |
| 2016/0197416 | A1 | 7/2016 | Jarmuth | |

FOREIGN PATENT DOCUMENTS

| | | | |
|---|---|---|---|
| DE | 20 2010 010 620 | U1 | 2/2012 |
| DE | 20 2012 103 581 | U1 | 1/2013 |
| DE | 10 2013 223 694 | A1 | 5/2014 |
| DE | 10 2014 202 414 | A1 | 8/2014 |
| DE | 20 2013 103 149 | U1 | 11/2014 |
| DE | 10 2013 108 952 | A1 | 3/2015 |
| DE | 10 2014 115 009 | B3 | 2/2016 |
| DE | 20 2014 010 621 | U1 | 3/2016 |
| EP | 1 742 299 | A2 | 1/2007 |

OTHER PUBLICATIONS

International Search Report and Written Opinion, dated Dec. 8, 2017, for International Application No. PCT/DE2017/100613, 21 pages. (with English Translation of Search Report).

International Preliminary Report on Patentability, dated Jan. 29, 2019, for International Application No. PCT/DE2017/100613, 12 pages.

Chinese Office Action for CN application No. 201780046907.3 dated Oct. 9, 2019, 8 pages.

* cited by examiner

ACTUATOR FOR A CONNECTION DEVICE FOR ELECTRICAL CONDUCTORS

BACKGROUND

Technical Field

The disclosure relates to an actuator for a connection device for electrical conductors for enabling an electrical conductor to be inserted into an insulating body in a non-actuated state, and for fixing and electrically contacting the electrical conductor to an electrical connection contact in an actuated state.

Such actuators are required in order to electrically and mechanically contact an electrical conductor, in particular a stranded conductor, within a connection device, to an electrical connection contact, e.g., a pin contact or a conductor bar, in a reversible manner, and if necessary to undo this contacting again.

Description of the Related Art

A multiplicity of connection devices of electrical conductors, in particular stranded conductors, are known in the prior art.

The publication EP 1 742 299 A2 describes a generic connection device for stranded conductors. In this case, a chamber having a displaceable slide element is provided in an insulating body for each stranded wire. The slide element is slid, together with a clamping sleeve with the inserted stranded conductor, onto a connection region of a pin contact. The stranded wire in this case is clamped-in between a clamping shoulder of the pin contact and the clamping sleeve, and is connected in an electrically conductive manner to the pin contact. At its cable connection region, the slide element has a laterally inclined, V-shaped recess, into which, in the plugged-in state, a correspondingly flat tool part such as, for example, a screwdriver, can be inserted, in order to lever the plugged-in slide element back out of the insulating body. For the use of the tool, an inclined portion is provided, on the inner side of the housing wall surface, in each chamber. Since the release is effected by the tool acting laterally on the insulating body, it usually cannot be performed if the insulating body is incorporated in a mount-on housing of a plug-and-socket connector.

The publication DE 20 2010 010 620 U1 proposes an arrangement, comprising a cage clamp, by which it is made possible for a conductor to be easily connected to and released from a spring contact element. It is possible for conductors to be connected to and released from the plug-and-socket connector without the use of an aid or tool, and without the expenditure of a large amount of force.

The publication DE 20 2014 010 621 U1 proposes arranging on the actuating means a springing push-push mechanism, similar to a ballpoint pen mechanism, by means of which the actuating means can be moved linearly between the first end position and the second end position.

The publication DE 10 2014 115 009 B3 discloses a plug-and socket connector, consisting of an insulating body, at least one electrical contact accommodated in the insulating body, and an actuating mechanism for the electrical contact, which consists of a first actuating pin and of a second actuating pin. The electrical contact has a spring contact element, for contacting an electrical conductor or cable, that is opened and closed by the first actuating pin. The second actuating pin is provided for opening the spring contact element. Consequently a tool or other aid is not required, either for closing or opening the spring contact element.

In the case of this prior art, disadvantages may arise because of the size of the corresponding structural form, if such insulating bodies are incorporated in grommet housings or mount-on housings having predefined dimensions. For this purpose, the dimensions of the insulating bodies must fit into the predefined housing dimensions. At the same time there is the need, including after the incorporation of such an insulating body into a mount-on housing, to perform releasing of the conductors, in particular from the cable connection side, without for this purpose having to remove the entire insulating body again from the mount-on housing. Furthermore, the possibility is required to use cable-connection-side jumpers between the individual contact chambers.

BRIEF SUMMARY

Advantageously, embodiments of the present invention provide a structural form that, on the one hand, allows the insulating body to be designed as small as possible, and at the same time enables the electrical conductors to be released manually even if the insulating body is already incorporated in a mount-on housing, and that furthermore, on the cable connection side, allows the use of plug-in jumpers for the electrically conductive connection of two stranded wires and thus, clearly, also of the associated contacts.

According to embodiments of the present invention, an actuator for a connection device for electrical conductor is provided and serves to enable an electrical conductor to be inserted into an insulating body in the non-actuated state, and to fix and electrically contact the electrical conductor to an electrical connection contact in an actuated state.

The electrical connection contact may comprise a conductor bar on the cable connection side, and a contact pin or a contact socket on the plug-in side. However, in this case it may also be, for example, a pin contact having a clamping shoulder on the cable connection side. The electrical conductor may be, in particular, a stranded conductor. The stranded conductor may be provided with a ferrule terminal on its bared region. However, it may also be a solid conductor.

According to an embodiment, the actuator comprises the following: means for bringing the actuator from the non-actuated state into the actuated state; and means for bringing the actuator from the actuated state into the non-actuated state. The means for bringing the actuator from the actuated state into the non-actuated state comprise an inclined application portion and, adjoining the latter, an application edge, and in particular an application step that begins at the application edge and that is oriented away at an obtuse angle from the inclined application portion.

Embodiments of the invention have the particular advantage that a release is effected by bringing the actuator from the actuated state into the non-actuated state by use of a tool, e.g., a standard slot-head screwdriver, from the direction of the cable connection side, thus may be effected even if the insulating body is already incorporated in the mount-on housing. Accordingly, for the purpose of releasing, the tool is first inserted almost perpendicularly in relation to the cable connection surface, i.e., coming from the cable connection direction, into the actuation opening between the actuator and an outer wall of the insulating body.

The tool is then first brought into mechanical contact with the inclined application portion, over the entire length thereof, and thereupon, in a lever movement, levers the actuator out of the insulating body by a first distance. The tool is thereupon automatically applied in a transitionless manner at the application edge and/or at the application step of the actuator that has already been levered out of the insulating body by the first distance and, by the same lever movement, in the further course thereof, levers the actuator out of the insulating body by a second distance, such that the actuator is then in its non-actuated state. Although, in the said further course of the lever movement, the tool is applied significantly more obliquely, and at the end of this operation even almost at right angles to its original direction, this is nevertheless unproblematic, since in this phase the actuator has already been levered out of the insulating body to such an extent that such an oblique application of the tool to the application edge or application step of the actuator is possible, even if the insulating body is incorporated in the mount-on housing.

In particular, the application edge may also be rounded and thus, for example, transition on the one hand seamlessly into the inclined application portion and/or on the other hand seamlessly into the application step, such that the term application edge thus also includes a rounded application portion that, in this context, has the same or similar functional effect.

Owing to the possibility for use of a slot-head screwdriver, the corresponding connection device can be assembled on-site and, as previously described, can also be disassembled on-site even when having been incorporated in the mount-on housing, i.e., the inserted electrical conductors can also be released manually without use of a special tool. This is particularly advantageous, since no special tool is thus required even for release.

Furthermore, embodiments of the invention have the advantage that the structural form is of a geometrically compact design, i.e., the insulating body has comparatively small dimensions, and can thus be inserted without difficulty into existing plug-in connector housings, in particular grommet housings and mount-on housings that have correspondingly small dimensions.

Furthermore, this structural form has the advantage that the contacts can be bridged on the cable connection side, i.e., can be electrically connected via one or more jumpers.

In an advantageous design, the actuator, for the purpose of bringing it from the non-actuated state, i.e., its non-actuated position, into the actuated state, i.e., its actuated position, has a recess for application of a tool, wherein the recess is at least partly in the form of a slot, e.g., for application of a slot-head screwdriver, and/or at least partly cylindrical, e.g., for application of a pin. This is advantageous for the said on-site assembly capability, since such tools are usually carried by a corresponding technician. In a further advantageous design, the actuator has an actuation recess having an inclined tensioning portion and, adjoining the latter, a tensioning shoulder for actuating a cage clamp.

This is advantageous, because by such structures a cage clamp can be actuated and held in a tensioned state, since this renders possible a structural form of small size.

According to some embodiments, the connection device comprises an electrical connection contact having a conductor bar, the insulating body having the actuation opening and a cable insertion opening for insertion of the electrical conductor, and a cage clamp, which is arranged substantially between the actuation opening and the cable insertion opening, and which, for its part, has a window recess, by which it is arranged in the cable insertion opening, and which additionally has a tensioning limb, which is arranged in the region of the actuation opening, for the purpose of acting in combination with the actuator.

If the actuator is in its actuated state, i.e., at its actuated position in the actuation opening of the insulating body, the tensioning limb of the cage clamp sinks into the actuation recess of the actuator. The cage clamp is then at least partly untensioned. At the same time, the cage clamp, by its window recess, encompasses the electrical conductor and draws it against the conductor bar in order to contact it electrically to the latter.

For the purpose of releasing the connection device, a tool is then inserted, from the cable connection side, into the actuation opening between the actuator and an outer wall of the insulating body. The tool is then brought into mechanical contact with the inclined application portion, over the entire length thereof, and levers the actuator out of the insulating body by a first distance, i.e., in the direction of the cable connection side, in order thereupon to be applied in a transitionless manner at the application edge and, subsequently, possibly also at the application step of the actuator that has already been levered out of the insulating body by the first distance, and to lever the actuator out of the insulating body by a second distance, i.e., in the direction of the cable connection side, and thus ultimately to bring the actuator into its non-actuated state. It is particularly advantageous in this case that the actuator travels both distances by a single lever movement of the screwdriver.

During this release operation, the actuator slides, with its inclined tensioning portions of its actuation recess, along the tensioning limb of the cage clamp, and thus tensions the cage clamp, as a result of which the window recess thereof is pushed deeper into the cable insertion opening, and the clamping contact formed by it is thereby opened, in order to release the electrical conductor previously pressed by it against the conductor bar.

In order to keep the actuating forces as small as possible, in particular in the pressing of the actuator into the insulating body, and thus to improve the operability, it is provided, in an advantageous development, to produce at least one friction partner, in particular the actuator and/or the insulating body, from a material having particularly advantageous tribological properties, such that the corresponding friction factor is reduced. This is additionally particularly advantageous, because as a result there is also no need for an elaborate, so-called "greasing" of the friction partners, i.e., the coating of their surface with a suitable lubricant at the respective friction regions.

For example, a polycarbonate (PC), having an appropriate proportion of polytetrafluorethylene (PTFE), may be used as such a material for the actuator and/or the insulating body. Alternatively or in addition, polyamide (PA), polyoxymethylene (POM) and similar substance, with and without corresponding additives having good tribological properties, could also be used.

The cage clamp is usually composed of metal, in particular resilient steel. In a very special development, however, it is also conceivable for the cage clamp also to be composed of a plastic. In this case, the aforementioned material properties clearly also apply to the cage clamp, i.e., a polycarbonate having an appropriate proportion of PTFE may be used for the cage clamp. Alternatively or additionally, PA, POM, and other materials, known to persons skilled in the art, with and without corresponding additives having good tribological properties, may also be used.

BRIEF DESCRIPTION OF THE SEVERAL VIEWS OF THE DRAWINGS

An exemplary embodiment of the invention is represented in the drawings and explained in greater detail in the following. There are shown.

The figures contain partly simplified, schematic representations. In some cases identical references are used for elements that are similar, but possibly not identical. Different views of the same elements may differ in scale.

DETAILED DESCRIPTION

Figure 1A:
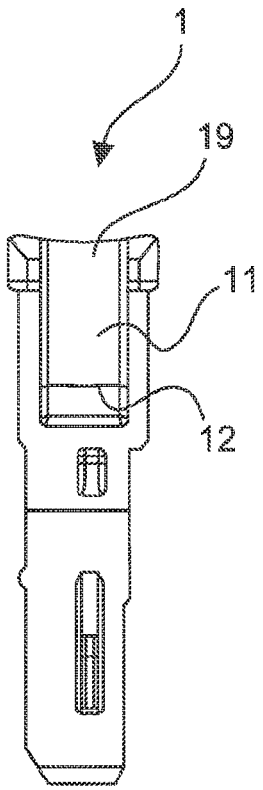
FIG. 1*a, b, c* an actuator, in differing views and in section.

FIG. 1*a* shows an actuator 1, viewed toward an inclined application portion 11 and, adjoining the latter, an application edge 12. In addition, there is a tool insertion opening 19 in the upper region.

Figure 1B:
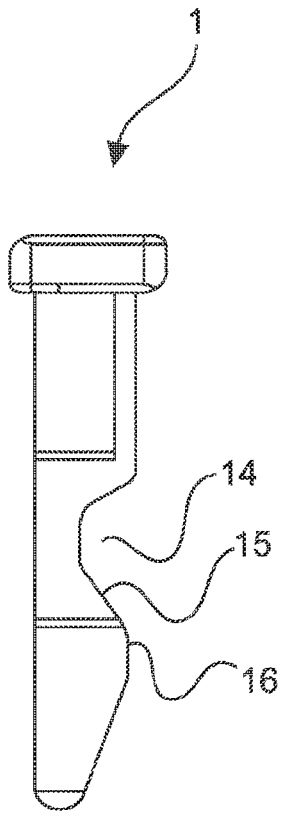

FIG. 1*b* shows the actuator 1 in a side view. From this view, an actuation recess 14 can be seen, which has an inclined tensioning portion 15. Adjoining the latter, the actuator 1 has a tensioning shoulder 16.

Figure 1C:
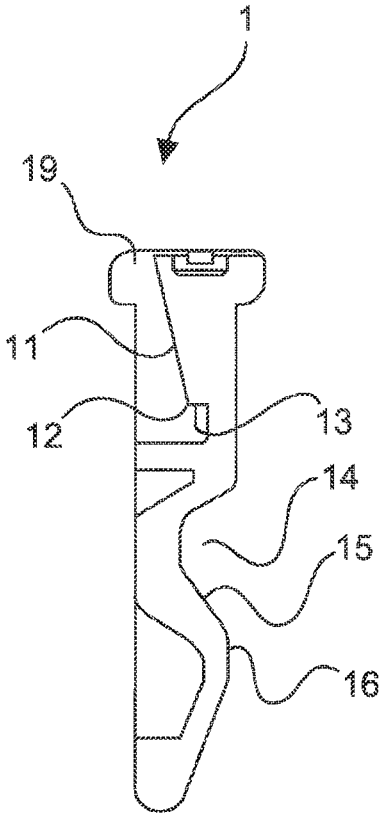

FIG. 1*c* shows the actuator 1 in a sectional representation, from the same perspective as the previous representation in FIG. 1*b*. In this case, the tool insertion opening 19 and the inclined application portion 11, the application edge 12 and an application step 13 are clearly visible. These are suitable for bringing the actuator 1 from its actuated state into its non-actuated state.

Figure 2A:
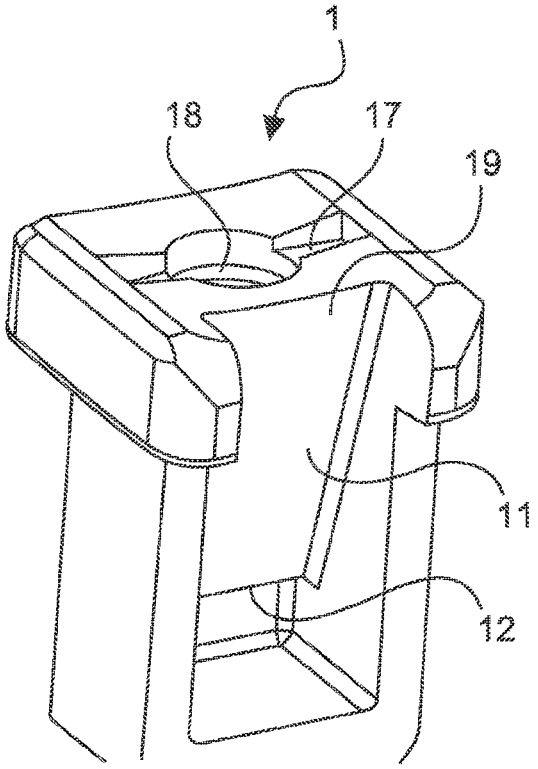
FIG. 2*a, b, c* the upper part of the actuator, in differing views and in section.
Figure 2B:
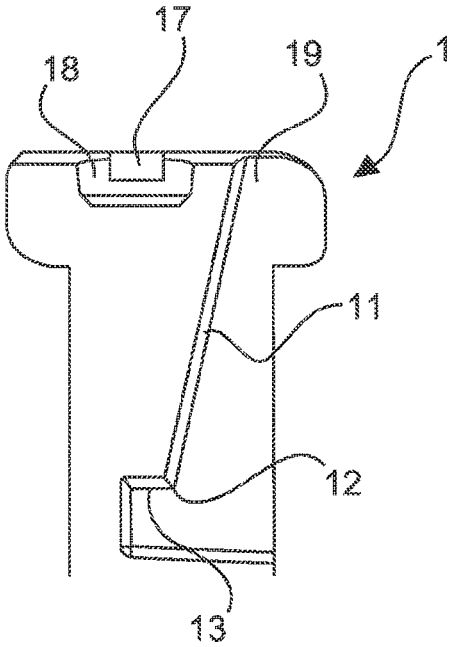
Figure 2C:
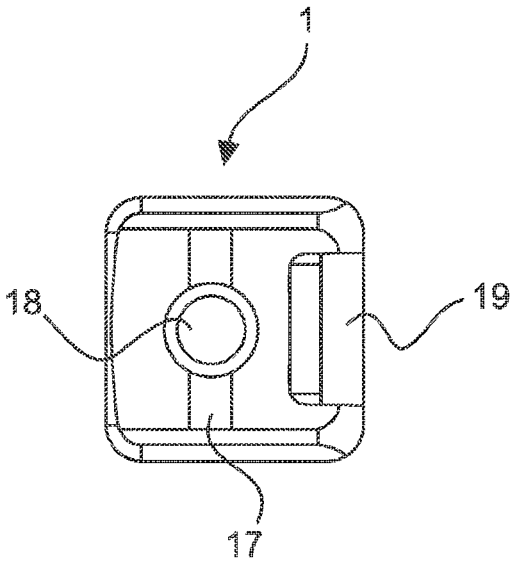

FIGS. 2*a*, 2*b* and 2*c* show the upper region of the actuator 1 in an oblique top view, in a further sectional representation and in a top view. The shape of the inclined application portion 11 is shown particularly clearly in FIG. 2*a*. The application step 13 can be seen particularly well in FIG. 2*b*, and the shape and position of the tool insert opening 19 is shown very clearly in FIG. 2*c*. Furthermore, a slot-type recess 17 and a cylindrical recess 18 are shown in all three representations. The latter serve to bring the actuator 1 from the non-actuated stated into the actuated state. For example, a slot-head screwdriver 7 (FIG. 5*a*), not shown in this representation, can be applied to the slot-type recess 17, in order to press the actuator 1 downward. The cylindrical recess 18 would instead be suitable for the application of a pin or similar.

Figure 3:
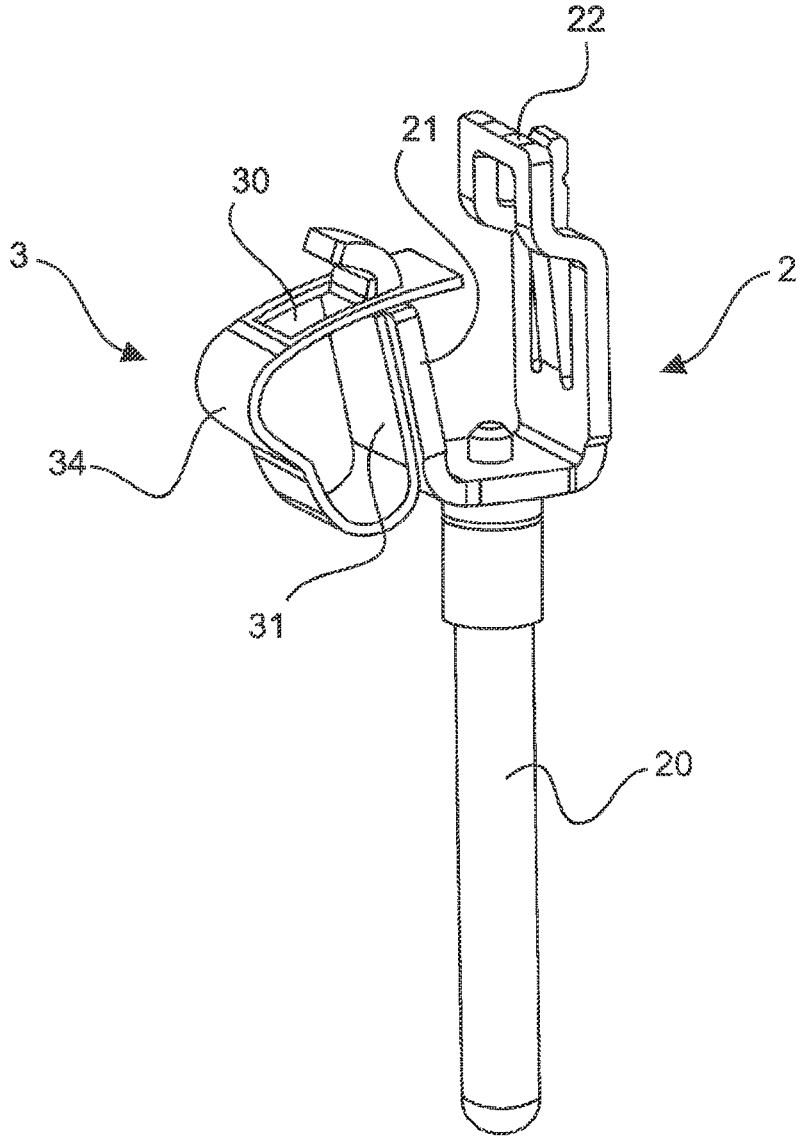
FIG. 3 an electrical connection contact with conductor bar and contact pin, and with a cage clamp arranged on the conductor bar.

FIG. 3 shows and electrical connection contact 2 having a plug-in side contact pin 20, a fastening clamp 22 for fastening in or to an insulating body 5 (FIGS. 4*a* and 4*b*), not shown here, and a conductor bar 21 on the cable connection side, the cage clamp 3, via its flat contact surface 31, bearing against the conductor bar 21 over a large area. The cage clamp 3 additionally has a window recess 30, by which it encompasses a slightly angled, free end of the conductor bar 21 that adjoins its contact surface 31, and additionally encompasses an angled end of the conductor bar 21 that is directed away from the contact pin 20, and thus, by its spring force, presses its contact surface 31 against the conductor bar 21.

At a region that faces away from the contact surface 31, the cage clamp 3 has a tensioning limb 34 which, in an at least partly non-tensioned state, which is the state of the cage clamp 3 shown in this representation, already indicates the contour of the actuation recess 14 of the actuator 1. In fact, the cage clamp 3 is designed to sink, by way of its tensioning limb 34, into the actuation recess 14 of the actuator 1, and act together mechanically with the actuation recess 14.

Figure 4A:
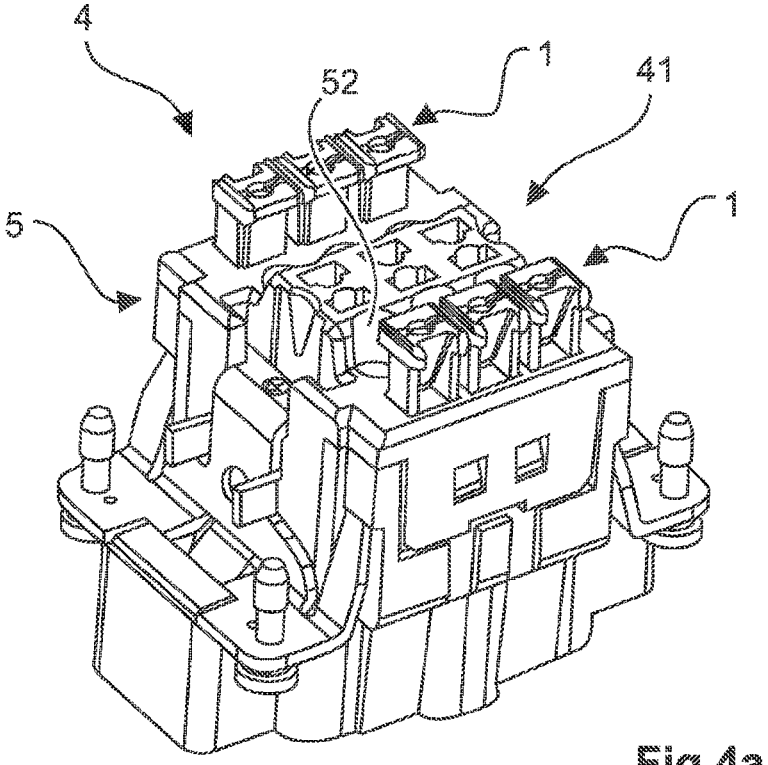
FIG. 4*a, b* a connection device, as viewed toward the cable connection side, in an oblique top view and in section.
Figure 4B:
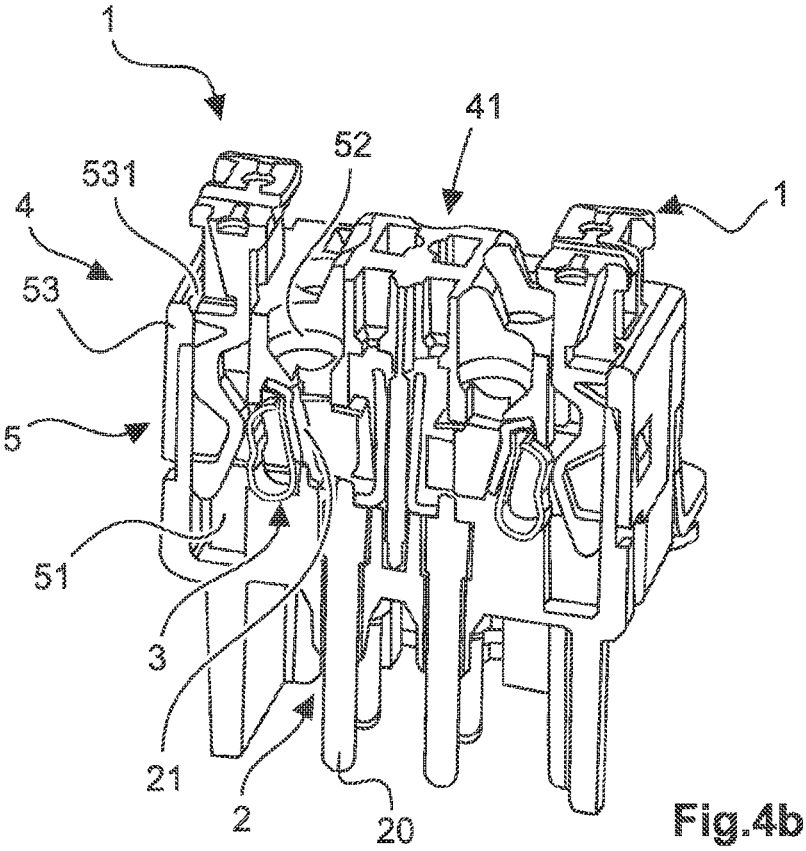

FIG. 4*a* shows a connection device 4 in a 3D representation, viewed toward the connection side 41. FIG. 4*b* shows the connection device 4 from a somewhat different perspective, with a section through its plane of symmetry.

The connection device 4 comprises an insulating body 5. The insulating body 5 has an actuation opening 51, into which the actuator 1 is inserted in its non-actuated position, and a cable insertion opening 52, located in which is the window recess 30 of the cage clamp 3, only the rear region of the window recess 30 being visible, in section, in the sectional representation. Since the section goes through the plane of symmetry of the mirror-symmetrical connection device 1, this representation clearly shows the position of the window recess 30 in the cable insertion opening 52 in the non-actuated state.

In addition, the conductor bar 21 of the connection contact 2 is arranged in the cable insertion opening 52. It can thus be clearly seen that the cage clamp 3 is arranged substantially between the actuation opening 51 and the cable insertion opening 52, which means that on the one hand, its tensioning limb 34, upon actuation of the actuator 1, can also sink into the actuation recess 14 thereof, and thus into the actuation opening 51 of the insulating body 5, and that the cage clamp 3 on the other hand, by its window recess 30, engages in the cable insertion opening 52 or even engages through the latter, at least in the non-actuated state, by way of its second free end located at the window recess 30.

The insulating body 5 additionally has an outer wall 53 having a lever contour 531.

Figure 5A:
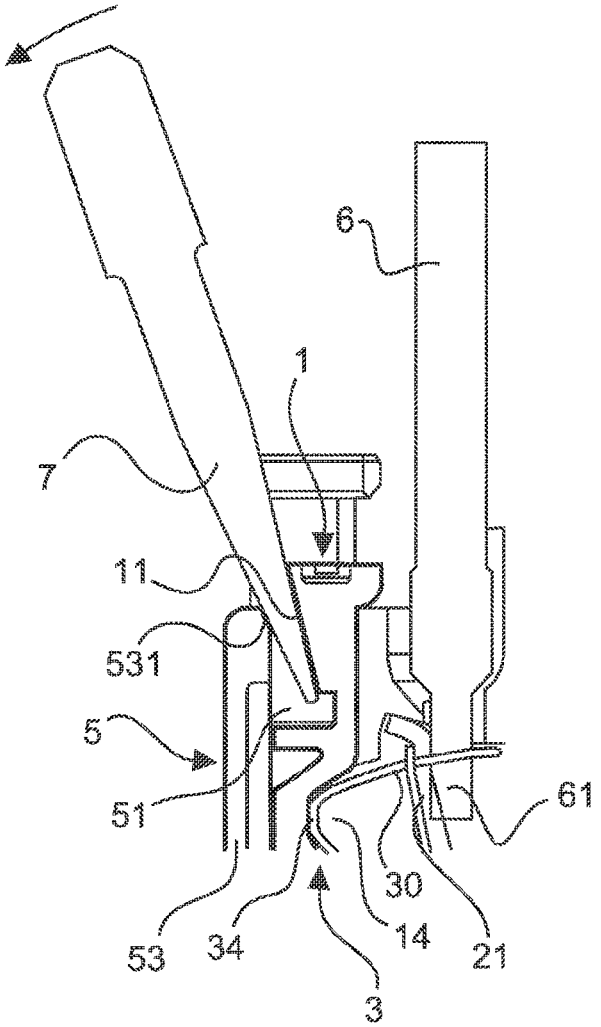
FIG. 5*a, b* a release operation, in a sectional representation.
Figure 5B:
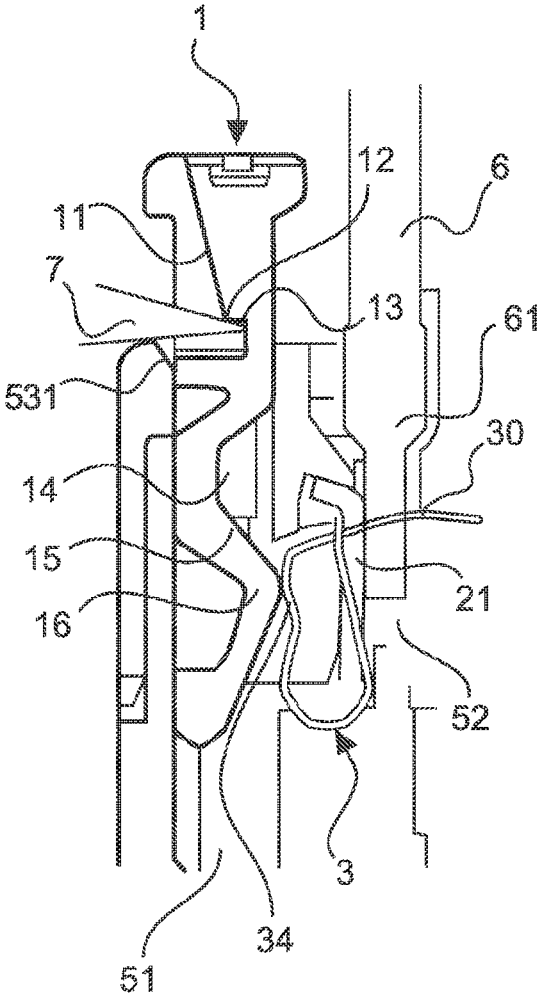

FIGS. 5*a* and 5*b* illustrate the release operation, in which the actuator 1 is brought from its actuated state, i.e., its actuated position in the insulating body 5, into its non-actuated state, i.e., its non-actuated position in the insulating body 5.

FIG. 5*a* shows the actuator 1 in its actuated state, i.e., its actuated position. The cage clamp 3 is at least partly untensioned, since its tensioning limb 34, represented at the lower edge of the figure, is sunk into the actuation recess 14 of the actuator 1. At the same time, the cage clamp 3, by way of its window recess 30, draws a bared region 61, in this case a stranded wire, of the electrical conductor 6 against the conductor bar 21, to which it is thereby connected in an electrically conductive manner.

For the purpose of release, a tool 7, namely in this case a slot-head screwdriver, is then inserted through the tool insertion opening 19 of the actuator 1, into the actuation opening 51, and thus between the actuator 1 and an outer wall 53 of the insulating body 5. The slot-head screwdriver 7 is then applied, on the one hand, at the application surface 11 of the actuator 1, over the entire length thereof. On the other hand, it is in mechanical contact with the lever contour 531 of the outer wall 53.

By levering in the direction of the arrow, it presses the actuator 1 upward by a first distance, i.e., out of the actuation opening 51. During this operation, owing to the lever contour 531, a change also occurs in the rotation axis of the lever, in the direction of release of the actuator 1, as a result of which the portion in which the tool 7 is applied in an optimal orientation to the inclined actuation portion 11 is lengthened. It can easily be seen that, upon further levering in this direction, the slot-head screwdriver 7 is applied at the application edge 12, but if it were to have a slightly different shape it could also be applied at the application step 13.

FIG. 5*b* shows the actuator 1 in its non-actuated state, i.e., in a non-actuated position. The slot-head screwdriver 7 levers by way of an upper edge of the lever contour 531, and thereby is applied at the application edge 12 of the actuator 1.

The tensioning limb 34 of the cage clamp 3 is fixed by the tensioning shoulder 16 of the actuator 1 in the direction of the conductor bar 21, after having previously already been moved in this direction by the inclined tensioning portion 15, and thus releases the electrical conductor 6 at the bared region 61 thereof.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An actuator for a connection device for electrical conductors, for:

enabling an electrical conductor to be inserted into an insulating body in a non-actuated state, and fixing and electrically contacting the electrical conductor to an electrical connection contact in an actuated state, the actuator comprising:

means for bringing the actuator from the non-actuated state into the actuated state, and means for bringing the actuator from the actuated state into the non-actuated state, wherein the means for bringing the actuator from the actuated state into the non-actuated state comprise an inclined application portion that extends from an upper end of the actuator downward and toward a receiving area for the electrical conductor and an application edge that adjoins the inclined application portion, and wherein the means for bringing the actuator from the actuated state into the non-actuated state additionally comprise an application step that begins at the application edge and that is oriented away at an obtuse angle from the inclined application portion.

2. The actuator as claimed in claim 1, wherein the means for bringing the actuator from the non-actuated state into the actuated state comprise at least one recess for application of a tool, wherein the recess is at least partly in the form of a slot, and/or at least partly cylindrical.

3. An actuator for a connection device for electrical conductors, for:

enabling an electrical conductor to be inserted into an insulating body in a non-actuated state, and fixing and electrically contacting the electrical conductor to an electrical connection contact in an actuated state, the actuator comprising:

means for bringing the actuator from the non-actuated state into the actuated state, and means for bringing the actuator from the actuated state into the non-actuated state, wherein the means for bringing the actuator from the actuated state into the non-actuated state comprise an inclined application portion that extends from an upper end of the actuator downward and toward a receiving area for the electrical conductor and an application edge that adjoins the inclined application portion, and wherein the actuator additionally has an actuation recess having an inclined tensioning portion and, adjoining the inclined tensioning portion, a tensioning shoulder for actuating a cage clamp.

4. A connection device, comprising:

an actuator for a connection device for electrical conductors, for:

enabling an electrical conductor to be inserted into an insulating body in a non-actuated state, and fixing and electrically contacting the electrical conductor to an electrical connection contact in an actuated state, the actuator comprising:

means for bringing the actuator from the non-actuated state into the actuated state, and means for bringing the actuator from the actuated state into the non-actuated state, wherein the means for bringing the actuator from the actuated state into the non-actuated state comprise an inclined application portion that extends from an upper end of the actuator downward and toward a receiving area for the electrical conductor and an application edge that adjoins the inclined application portion;

the electrical connection contact, which comprises a conductor bar;

the insulating body, which has an actuation opening and a cable insertion opening for insertion of an electrical conductor; and a cage clamp, arranged substantially between the actuation opening and the cable insertion opening, having a window recess by which, at least in the non-actuated state of the actuator, the window recess is arranged in the cable insertion opening, and which has a tensioning limb, which is arranged in a region of the actuation opening, for the purpose of acting in combination with the actuator.

5. The connection device as claimed in claim 4, wherein in the actuated state of the actuator, the tensioning limb is in mechanical contact with an actuation recess of the actuator, and in this case the cage clamp which, by the window recess, encompasses the electrical conductor, and draws the electrical conductor against the conductor bar for the purpose of connecting the electrical conductor in an electrically conductive manner, in the form of a clamping contact, to the connection contact.

6. A method for releasing a connection device that comprises:

an insulating body, which has an actuation opening and a cable insertion opening;

an electrical connection contact;

an actuator for enabling an electrical conductor to be inserted into the insulating body in a non-actuated state, and for fixing and electrically contacting the electrical conductor to the electrical connection contact in an actuated state; and a cage clamp, which is arranged substantially between the actuation opening and the cable insertion opening of the insulating body, and has a window recess by which, at least in the non-actuated state of the actuator, the window recess is arranged in the cable insertion opening, and which has a tensioning limb, which is arranged in a region of the actuation opening, for acting in combination with the actuator, wherein the method comprises:

inserting a tool, from a direction of a cable connection side, into the actuation opening between the actuator and an outer wall of the insulating body such that the tool is first brought into mechanical contact with an inclined application portion of the actuator that extends from an upper end of the actuator downward and away from the outer wall of the insulating body, over an entire length thereof;

levering the actuator out of the insulating body by a first distance via a first portion of a lever movement such that the tool is thereupon automatically applied in a transitionless manner at an application edge of the actuator that has already been levered out of the insulating body by the first distance; and levering the actuator out of the insulating body by a second distance via a second portion of the lever movement, thereby bringing the actuator into the non-actuated state.

7. The method as claimed in claim 6, wherein, during levering the actuator out of the insulating body by the first distance and the second distance, the actuator slides, with an inclined tensioning portion of an actuation recess of the actuator, along the tensioning limb of the cage clamp, and tensions the cage clamp, as a result of which the window recess is pushed deeper into the cable insertion opening, in order to release the electrical conductor previously clamped therein by the window recess.

8. An actuator for a connection device for electrical conductors, for enabling an electrical conductor to be inserted into an insulating body in a non-actuated state, and for fixing and electrically contacting the electrical conductor to an electrical connection contact in an actuated state, the actuator comprising:

an actuator body having an inclined application portion that extends from an upper end of the actuator body downward and toward a receiving area for the electrical conductor and an application edge that adjoins the inclined application portion, wherein the inclined application portion and the application edge collectively enable the actuator body to be moved from the actuated state into the non-actuated state via a continuous lever movement, and wherein the actuator body includes an application step that begins at the application edge and that is oriented away at an obtuse angle from the inclined application portion.

* * * * *